US010099363B1

(12) United States Patent
Hsieh

(10) Patent No.: US 10,099,363 B1
(45) Date of Patent: Oct. 16, 2018

(54) ADJUSTABLE HAND TOOL COLLECTING RACK

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 15/654,127

(22) Filed: Jul. 19, 2017

(30) Foreign Application Priority Data

Jun. 22, 2017 (TW) ..... 106120857 A

(51) Int. Cl.

| | |
|---|---|
| ***B25H 3/04*** | (2006.01) |
| ***A47B 57/58*** | (2006.01) |
| ***A47G 29/08*** | (2006.01) |
| ***A47B 65/00*** | (2006.01) |

(52) U.S. Cl.
CPC ..... *B25H 3/04* (2013.01); *A47B 57/586* (2013.01); *A47B 65/15* (2014.12); *A47G 29/08* (2013.01)

(58) Field of Classification Search
CPC ..... A47B 57/58; A47B 57/583; A47B 57/586; A47B 65/15; A47F 5/005; B25H 3/04
USPC ..... 248/346.06; 211/10, 11, 40, 42, 43, 175, 211/184
See application file for complete search history.

(56) References Cited

U.S. PATENT DOCUMENTS 992,047 A * 5/1911 Peak ..... B42F 17/02 211/184
1,363,138 A * 12/1920 Markham ..... A47B 65/20 211/43
1,901,365 A * 3/1933 Field ..... B42F 17/02 211/184
2,271,250 A * 1/1942 Buchholz ..... A47F 5/005 248/222.52
2,415,054 A * 1/1947 Weil ..... B42F 17/02 206/425
2,954,878 A * 10/1960 Metzler ..... A47F 5/005 211/184
3,501,019 A * 3/1970 Armstrong ..... A47B 57/58 108/61
3,703,964 A * 11/1972 Field ..... A47F 5/005 211/184
3,780,876 A * 12/1973 Elkins ..... A47F 5/005 211/184

(Continued)

FOREIGN PATENT DOCUMENTS

GB 522074 A * 6/1940 ..... A47F 5/005

*Primary Examiner* — Michael Safavi
(74) *Attorney, Agent, or Firm* — Egbert Law Offices, PLLC

(57) ABSTRACT

An adjustable hand tool collecting rack includes a base formed with multiple T-shaped rails thereon. Each rail includes an elongated stub having two opposite sides each having a wing laterally extending therefrom. Multiple partition boards are transversally slidably mounted onto the base, wherein each partition board is vertical relative to the tool supporting surface of the base. Each partition board has multiple T-shaped grooves defined in a sliding side thereof, wherein each T-shaped groove is slidably coupled with a corresponding one of the T-shaped rails. Multiple protrusions laterally extend from two opposite faces of each of the multiple partition boards. Each protrusion has a lower side aligns with a contour of a top portion of a corresponding one of the multiple T-shaped grooves and the lower side of each of the multiple protrusions abuts a top portion of a corresponding one of the multiple rails.

14 Claims, 5 Drawing Sheets

(56) References Cited

U.S. PATENT DOCUMENTS

| | | | | | |
|---|---|---|---|---|---|
| 4,343,450 | A * | 8/1982 | Anderson | A47G 1/1646 | 248/454 |
| 5,072,835 | A * | 12/1991 | Price, Jr. | G11B 23/0236 | 206/387.15 |
| 5,199,584 | A * | 4/1993 | Fowler | A47F 5/0043 | 211/184 |
| 5,664,691 | A * | 9/1997 | Boivin-Paradis | A47B 57/583 | 211/175 |
| 5,924,564 | A * | 7/1999 | Lin | G11B 33/0422 | 206/308.1 |
| 6,308,839 | B1 * | 10/2001 | Steinberg | G11B 23/0236 | 211/184 |
| 6,648,150 | B2 * | 11/2003 | Hartstone | G11B 33/0461 | 211/11 |
| 7,395,938 | B2 * | 7/2008 | Merit | A47F 5/005 | 211/184 |
| 2007/0080126 | A1 * | 4/2007 | Music | A47F 5/005 | 211/184 |
| 2012/0205497 | A1 * | 8/2012 | Hunt | A47B 46/00 | 248/49 |
| 2014/0263134 | A1 * | 9/2014 | Walker | A47F 5/005 | 211/184 |

* cited by examiner

ADJUSTABLE HAND TOOL COLLECTING RACK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a tool rack, and more particularly to an adjustable hand tool collecting rack.

2. Description of Related Art Including Information Disclosed Under 37 CFR 1.97 and 37 CFR 1.98

In our daily life, various hand tools are usually necessary. For easy storage, these hand tools need to be well ordered.

A conventional tool rack is provided for collecting sockets. The conventional tool rack is formed with a rail and includes multiple tool holders slidably mounted on the rail. Each tool holder is formed with a cubic stub for holding the socket in place. However, this conventional has a unique function for sockets. Another conventional tool rack includes multiple clamps slidably mounted on the rail for clamping hand tools, such as screwdrivers, which has a shank. The conventional tool racks cannot be used for pliers or wrenches. In addition, the conventional tool rack cannot provide a great contact area for stably positioning the tools.

The present invention has arisen to mitigate and/or obviate the disadvantages of the conventional tool racks.

BRIEF SUMMARY OF THE INVENTION

The main objective of the present invention is to provide an improved adjustable hand tool collecting rack.

To achieve the objective, the adjustable hand tool collecting rack in accordance with the present invention comprises a base formed with a tool supporting surface and having multiple rails longitudinally formed on the tool supporting surface, wherein each rail is formed with at least one assembling end thereon. Each rail includes an elongated stub having two opposite sides each having a wing laterally extending therefrom such that each rail has a T-shaped cross-section. The base has a front side formed with a front panel and a rear side formed with a rear panel. Multiple partition boards are transversally slidably mounted onto the tool supporting surface of the base, wherein each partition board is vertical relative to the tool supporting surface of the base. Each partition board has a plate-shaped main structure and a sliding side formed on the main structure. The partition board has multiple T-shaped grooves defined in the sliding side. Each T-shaped groove is defined into a first section and a second section, wherein the first section has a width smaller than that of the second section. The two wings of each of the multiple rails are slidably coupled with the second section of a corresponding one of the multiple T-shaped grooves and the stub of each of the multiple rails is slidably coupled with the first section of the corresponding T-shaped groove. Multiple protrusions laterally extend from two opposite faces of each of the multiple partition boards. Each protrusion has a lower side aligns with a contour of a top portion of a corresponding one of the multiple T-shaped grooves and the lower side of each of the multiple protrusions abuts a top portion of a corresponding one of the multiple rails.

Further benefits and advantages of the present invention will become apparent after a careful reading of the detailed description with appropriate reference to the accompanying drawings.

DETAILED DESCRIPTION OF THE INVENTION

Figure 1:
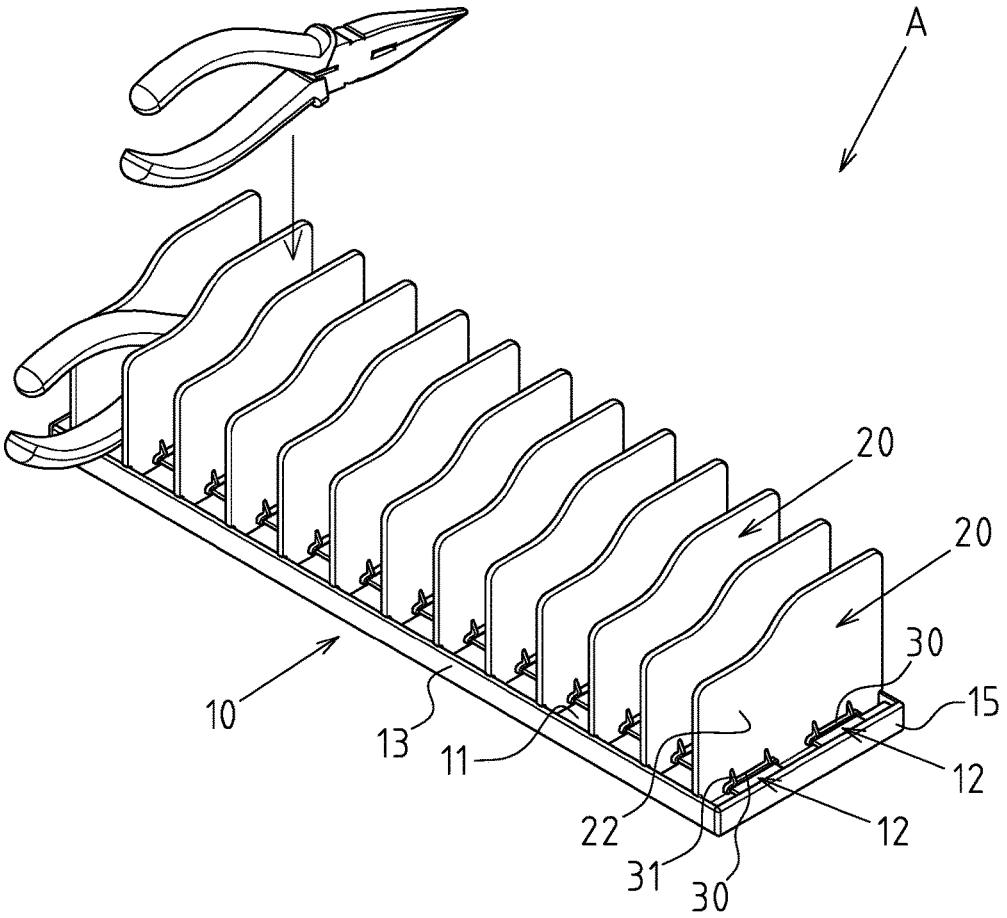
FIG. 1 is a perspective view of an adjustable hand tool collecting rack in accordance with the present invention.

Referring to the drawings and initially to FIGS. 1-5, an adjustable hand tool collecting rack A in accordance with the present invention comprises a base 10 formed with a tool supporting surface 11 and having multiple rails 12 longitudinally formed on the tool supporting surface 11, wherein each rail 12 is formed with at least one assembling end 123 thereon. Each rail 12 includes an elongated stub 121 having two opposite sides each having a wing 122 laterally extending therefrom such that each rail 12 has a T-shaped cross-section. The base 10 has a front side formed with a front panel 13 and a rear side formed with a rear panel 14. Multiple partition boards 20 are transversally slidably mounted onto the tool supporting surface 11 of the base 10, wherein each partition board 20 is vertical relative to the tool supporting surface 11 of the base 10. Each partition board 20 has a plate-shaped main structure 22 and a sliding side 21 formed on the main structure 22. The partition board 20 has multiple T-shaped grooves 23 defined in the sliding side 21. Each T-shaped groove 23 is divided into a first section 231 and a second section 232, wherein the first section 231 has a width smaller than that of the second section 232. The two wings 122 of each of the multiple rails 12 are slidably coupled with the second section 232 of a corresponding one of the multiple T-shaped grooves 23 and the stub 121 of each of the multiple rails 12 is slidably coupled with the first section 231 of the corresponding T-shaped groove 23. Multiple protrusions 30 laterally extend from two opposite faces of each of the multiple partition boards 20. Each protrusion 30 has a lower side aligns with a contour of a top portion of a corresponding one of the multiple T-shaped grooves 23 and the lower side of each of the multiple protrusions 30 abuts a top portion of a corresponding one of the multiple rails 12.

With reference to FIGS. 2 to 5, each protrusion 30 has multiple reinforcement ribs 31 extending therefrom and being connected to a corresponding one of the multiple partition boards 20. In the preferred embodiment of the present invention, the reinforcement ribs 31 are provided to strengthen the structure of each of the multiple protrusions 30.

Figure 2:
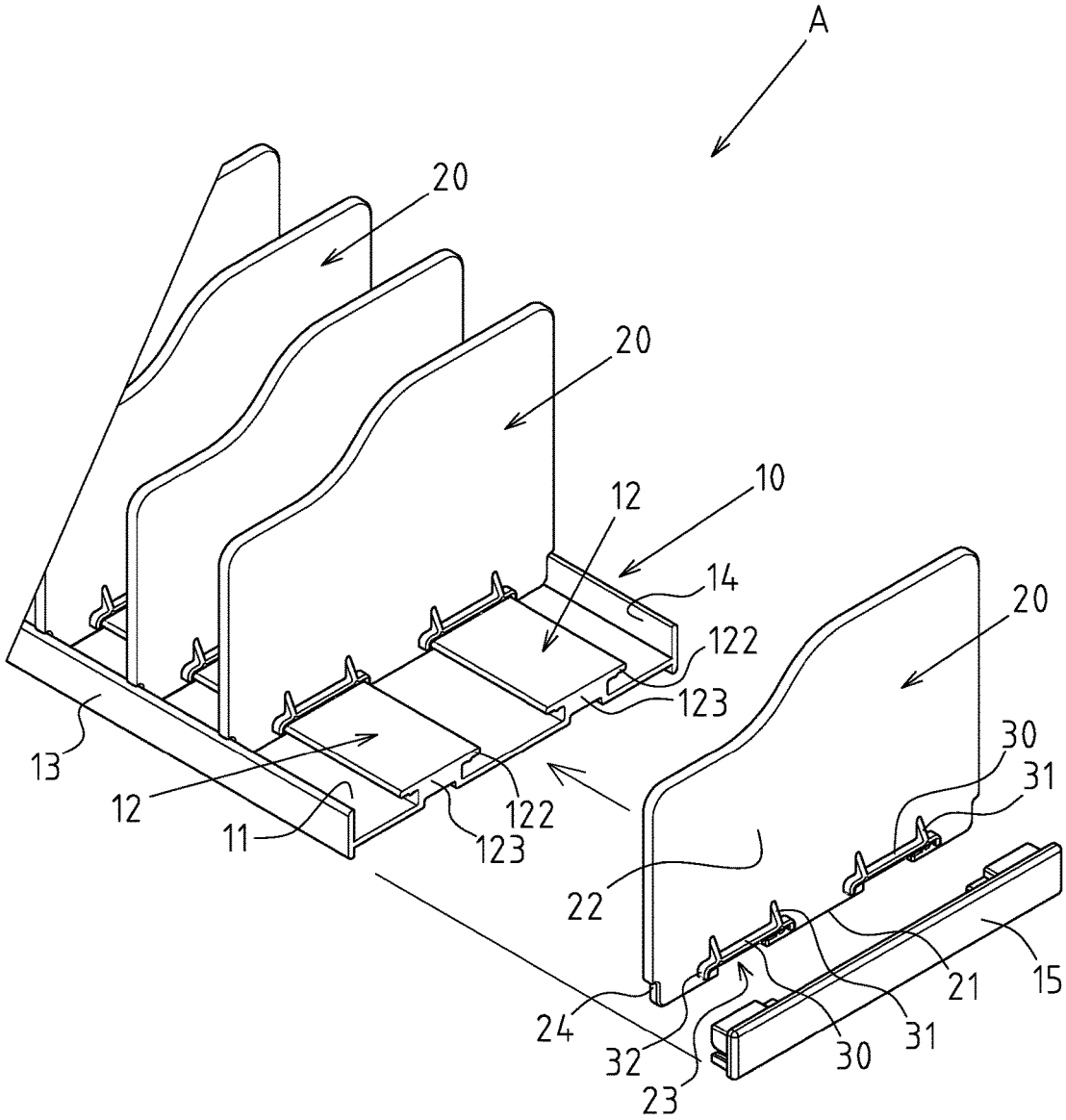
FIG. 2 is a partially exploded perspective view of the adjustable hand tool collecting rack in FIG. 1.
Figure 3:
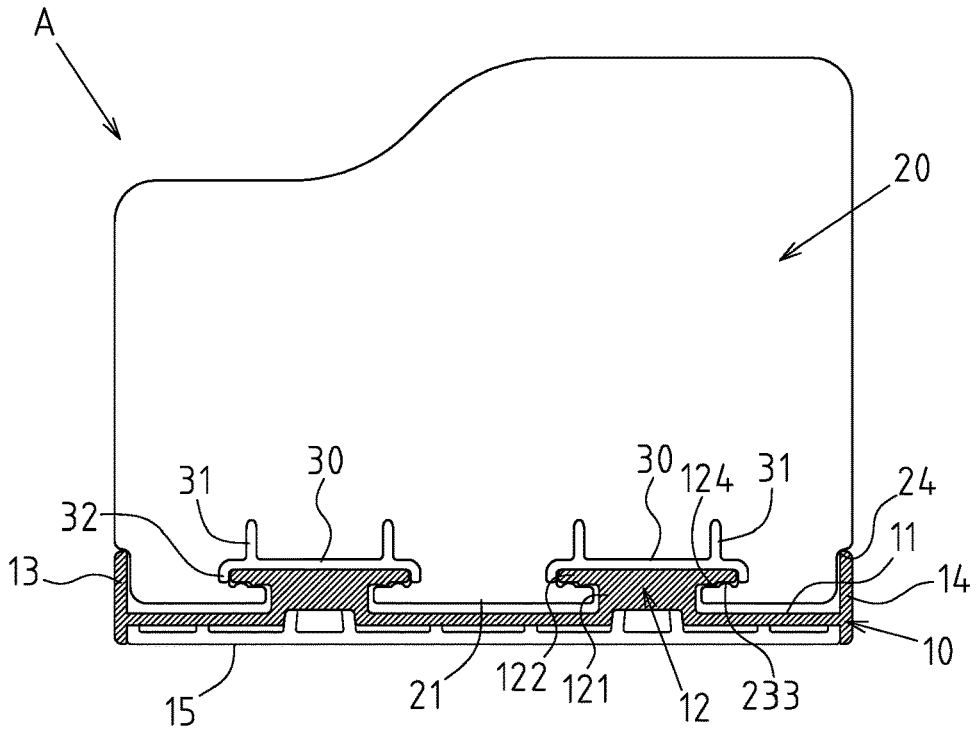
FIG. 3 is a cross-sectional view of the adjustable hand tool collecting rack in FIG. 1.
Figure 4:
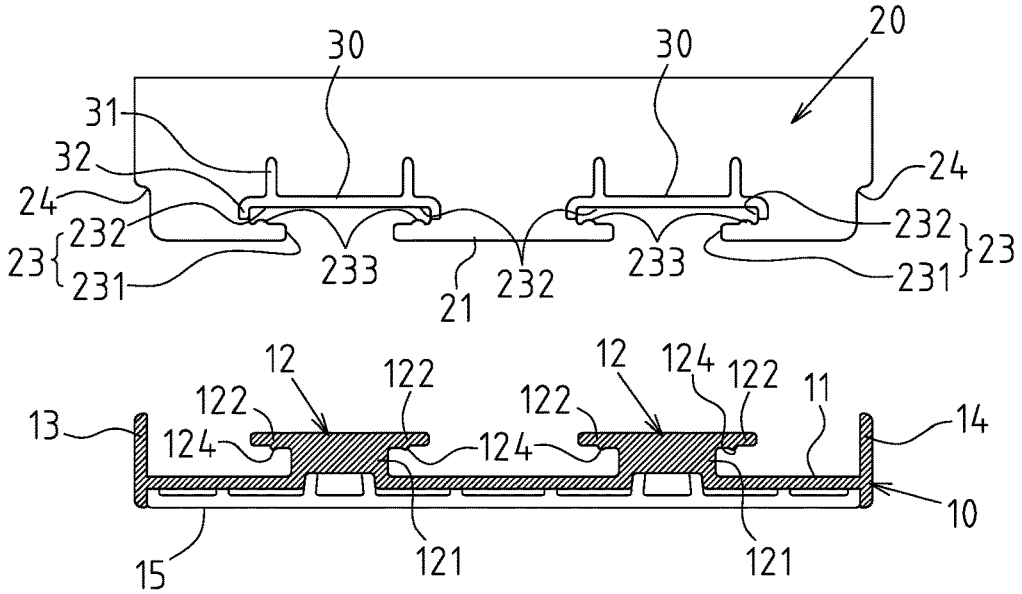
FIG. 4 is an exploded plan view in cross-section of the adjustable hand tool collecting rack in accordance with the present invention.
Figure 5:
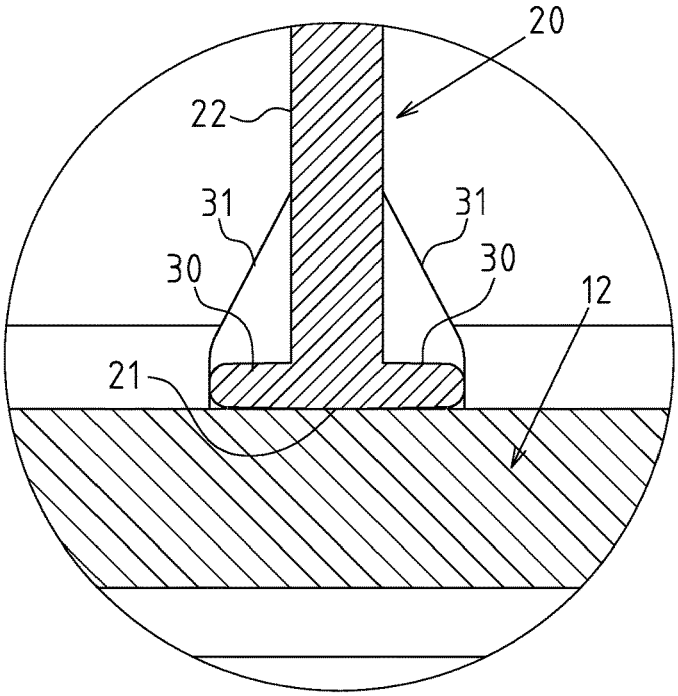
FIG. 5 is a partially cross-sectional view of the adjustable hand tool collecting rack in FIG. 1.

With reference to FIGS. 2 to 4, each protrusion 30 has two opposite ends respectively having a curved lip 32 extending therefrom for strengthening the structure of each of the multiple protrusions 30 and providing a stable support to a corresponding one of the partition boards 20.

Figure 7:
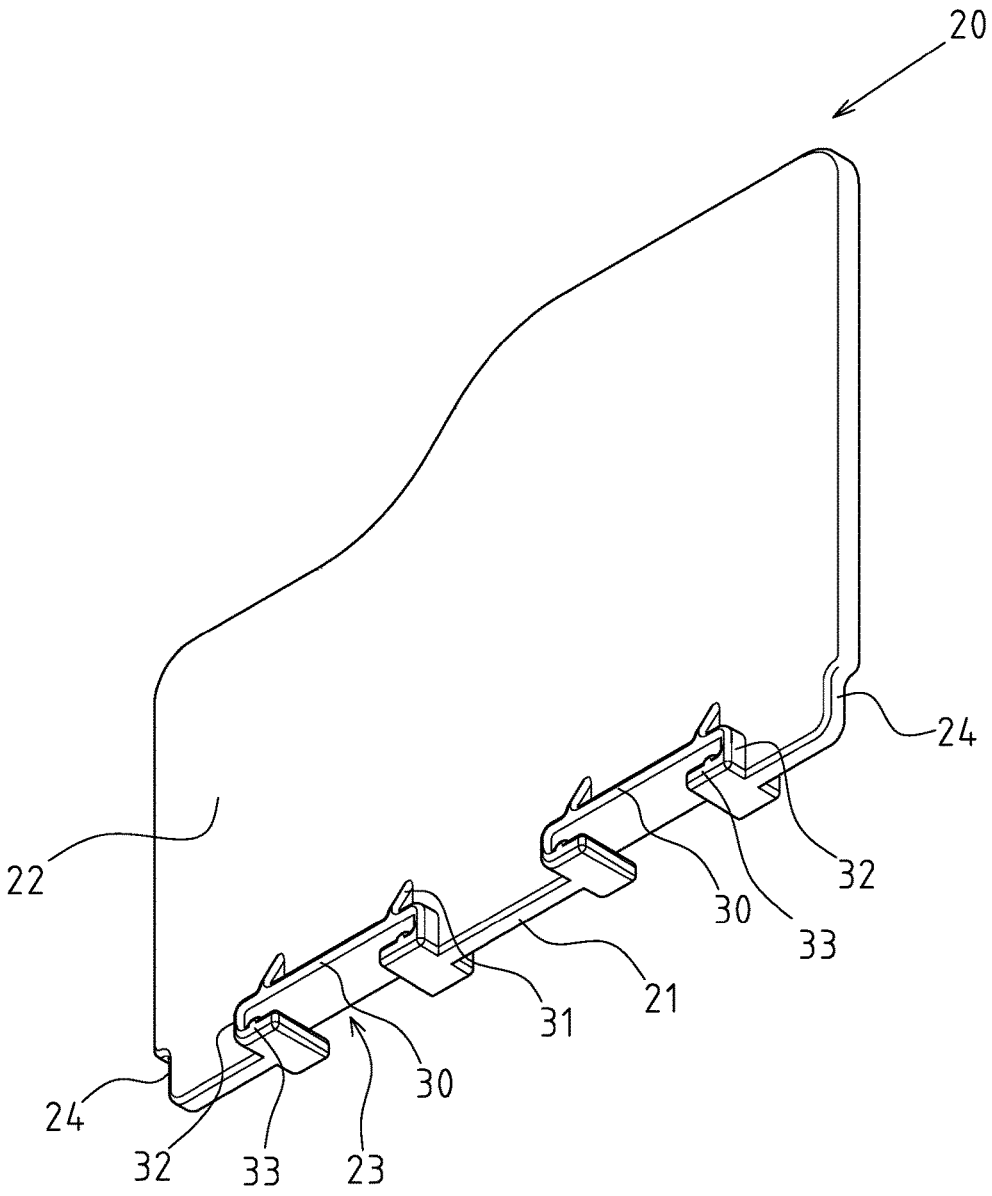
FIG. 7 is a perspective view of a second embodiment of a partition board of the adjustable hand tool collecting rack in accordance with the present invention.

With reference to FIG. 7 that shows a second embodiment of the adjustable hand tool collecting rack in accordance with the present invention, each protrusion 30 has two lateral lips 33 extending from a free of each of the two curved lips 32 thereof, wherein the two lateral lip 33 inwardly extend relative to a corresponding one of the T-shaped grooves 23. The two lateral lips 33 slidably abut two wings 122 of a corresponding one of the multiple rails 12 for enlarging a contact area and providing a stable operation between the partition board 20 and the rail 12.

With reference to FIGS. 3 and 4, each wing 122 of the multiple rails 12 has a first rib 124 formed on a back thereof, wherein each first rib 124 abuts against a bottom of the second section 232 of a corresponding one of the multiple T-shaped grooves 23. A bottom of the second section 232 of each of the multiple T-shaped grooves 23 has two opposite sides each having a second rib 233, wherein each second rib 233 abuts against the back of a corresponding one of the wings 122 of each of the multiple rails 12. Each first rib 124 is adjacent to a corresponding one of the second ribs 233 for providing a smooth movement to the partition board 20.

The sliding side 21 of each of the multiple partition board 20 has a front end and a rear end respectively abutting the front panel 13 and the rear panel 14. With reference to FIG. 3, the front end and the rear end of the sliding side 21 of each of the multiple partition board 20 respectively has an indentation 24 defined therein. Each indentation 24 is formed with a corner abutting the front/rear panel 13/14.

With reference to FIGS. 1 and 2, the adjustable hand tool collecting rack in accordance with the present invention further comprises an end piece 15 mounted to the assembling end 123 of the base 10 to prevent the partition board 20 from being overly moved relative to the base 10.

Figure 6:
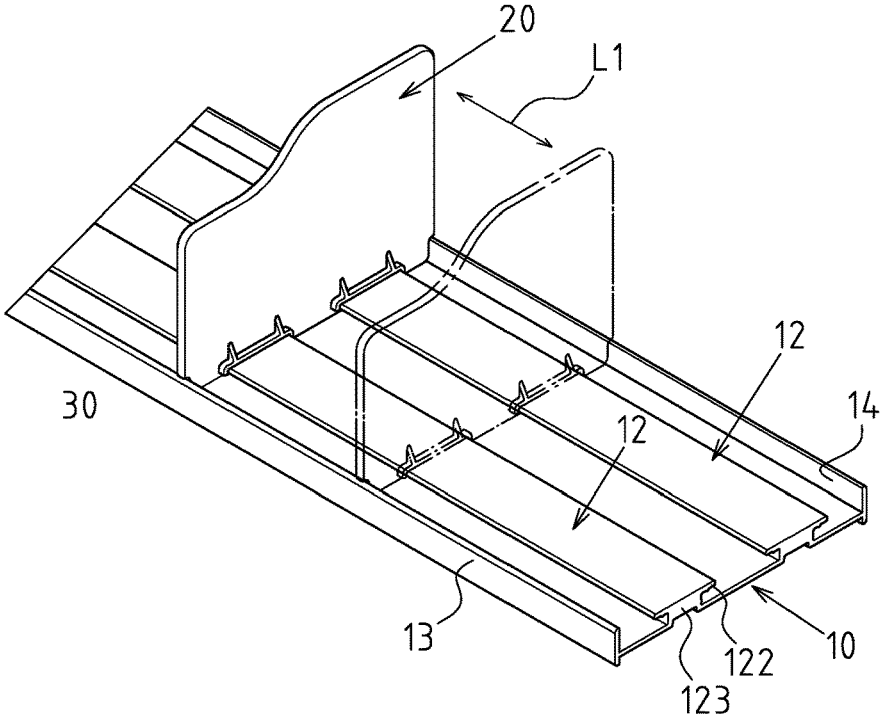
FIG. 6 is an operational view of the adjustable hand tool collecting rack in accordance with the present invention.

As described above, with reference to FIG. 1, every two adjacent partition boards 20 define a U-shaped receiving space with the base 10, wherein the receiving space is provided for receiving a hand tool, such as a pliers. In addition, the partition boards 20 are steplessly moved relative to the base 10 along the arrow L1 in FIG. 6 such that the receiving space is adjusted for various hand tools. The sliding side 21 of each of the multiple partition boards 20 stretches across multiple rails 12 such that each partition board 20 is stably slid on the base 10. Furthermore, the protrusions 30 of each of the multiple partition boards 20 promote the vertical accuracy between the base 10 and the partition boards.

Although the invention has been explained in relation to its preferred embodiment, it is to be understood that many other possible modifications and variations can be made without departing from the spirit and scope of the invention as hereinafter claimed.

I claim:

1. An adjustable hand tool collecting rack comprising:

a base formed with a tool supporting surface and having multiple rails longitudinally formed on the tool supporting surface, wherein each rail is formed with at least one assembling end thereon; each rail having an elongated stub with two opposite sides each having a wing laterally extending therefrom such that each rail has a T-shaped cross-section, the base having a front side formed with a front panel and a rear side formed with a rear panel;

multiple partition boards transversally slidably mounted onto the tool supporting surface of the base, wherein each of the partition boards is vertical relative to the tool supporting surface of the base, each partition board having a plate-shaped main structure and a sliding side formed on the main structure, the partition board having multiple T-shaped grooves defined in the sliding side, each T-shaped groove being divided into a first section and a second section, wherein the first section has a width smaller than a width of the second section, the two wings of each of the multiple rails slidably coupled with the second section of a corresponding one of the multiple T-shaped grooves and the stub of each of the multiple rails slidably coupled with the first section of the corresponding T-shaped groove; and multiple protrusions laterally extending from two opposite faces of each of the multiple partition boards, each protrusion having a lower side aligning with a contour of a top portion of a corresponding one of the multiple T-shaped grooves and the lower side of each of the multiple protrusions abutting a top portion of a corresponding one of the multiple rails.

2. The adjustable hand tool collecting rack of claim 1, wherein each protrusion has multiple reinforcement ribs extending therefrom and connected to a corresponding one of the multiple partition boards.

3. The adjustable hand tool collecting rack of claim 2, wherein each protrusion has two opposite ends respectively having a curved lip extending therefrom.

4. The adjustable hand tool collecting rack of claim 3, wherein the sliding side of each of the multiple partition board has a front end and a rear end respectively abutting the front panel and the rear panel.

5. The adjustable hand tool collecting rack of claim 3, wherein each protrusion has two lateral lips extending from each of the two curved lips thereof and the two lateral lips inwardly extend relative to a corresponding one of the T-shaped grooves, the two lateral lips slidably abutting two wings of a corresponding one of the multiple rails.

6. The adjustable hand tool collecting rack of claim 4, wherein the front end and the rear end of the sliding side of each of the multiple partition board respectively has an indentation defined therein and each indentation is formed with a corner abutting the front panel or the rear panel.

7. The adjustable hand tool collecting rack of claim 6, further comprising an end piece mounted to the assembling end of the base.

8. The adjustable hand tool collecting rack of claim 1, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

9. The adjustable hand tool collecting rack of claim 2, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

10. The adjustable hand tool collecting rack of claim 3, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

11. The adjustable hand tool collecting rack of claim 4, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

12. The adjustable hand tool collecting rack of claim 5, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

13. The adjustable hand tool collecting rack of claim 6, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

14. The adjustable hand tool collecting rack of claim 7, wherein each wing of the multiple rails has a first rib formed on a back thereof, each first rib abutting against a bottom of the second section of a corresponding one of the multiple T-shaped grooves, a bottom of the second section of each of the multiple T-shaped grooves having two opposite sides each having a second rib, wherein each second rib abuts against the back of a corresponding one of the wings of each of the multiple rails, wherein each first rib is adjacent to a corresponding one of the second ribs.

* * * * *